US007296906B1

(12) United States Patent
Wu

(10) Patent No.: US 7,296,906 B1
(45) Date of Patent: Nov. 20, 2007

(54) SOFT HANDLE HAVING A LIGHTING APPARATUS

(76) Inventor: Michael Chien-Lung Wu, 12F, No. 24, Chi Lin Road, Taipei (TW)

( * ) Notice: Subject to any disclaimer, the term of this patent is extended or adjusted under 35 U.S.C. 154(b) by 0 days.

(21) Appl. No.: 11/583,822

(22) Filed: Oct. 20, 2006

(51) Int. Cl.
*B25B 23/18* (2006.01)

(52) U.S. Cl. ..... 362/119; 362/101; 362/102; 362/109; 362/189; 362/205; 362/318; 362/399; 362/474; 362/806

(58) Field of Classification Search ..... 362/101, 362/102, 109, 119, 189, 205, 318, 399, 474, 362/806
See application file for complete search history.

(56) References Cited

U.S. PATENT DOCUMENTS 4,623,954 A * 11/1986 Schott et al. ..... 362/474
6,109,761 A * 8/2000 Smith et al. ..... 362/108
6,241,359 B1 * 6/2001 Lin ..... 362/96
2002/0089846 A1 * 7/2002 Shu ..... 362/118
2002/0145866 A1 * 10/2002 Chen ..... 362/120
2006/0124158 A1 * 6/2006 Lin et al. ..... 135/24

* cited by examiner

*Primary Examiner*—Stephen F. Husar
*Assistant Examiner*—Meghan K. Dunwiddie
(74) *Attorney, Agent, or Firm*—Rosenberg, Klein & Lee

(57) ABSTRACT

The invention relates to a soft handle having a lighting apparatus, which includes a lighting apparatus and a spring switch being received in one end of a shaft of the handle. The handle has a soft shell with inner liquid for comfortable use and has the lighting apparatus to emit lighting ray as a flashlight. The handle includes two functions in a single body and then obtains utilization and improvement.

2 Claims, 4 Drawing Sheets

SOFT HANDLE HAVING A LIGHTING APPARATUS

FIELD OF THE INVENTION

The present invention relates to a soft handle having a lighting apparatus, which includes a soft shell connecting with an inner shaft. A lighting apparatus is connected in one side of the shaft in order to provide lighting purpose for increasing utility.

BACKGROUND OF THE INVENTION

A handle including a soft shell for facilitating users to hold is popular in these days, which has a shell and a central shaft. Liquid is filled in the space between both. This known handle may have different connecting structure but all have the same single function for being held comfortably.

SUMMARY OF THE INVENTION

The present invention is to provide a soft handle, which connects with a lighting apparatus at one end of the shaft to provide a second function of the handle. Now, accompanying with the following drawings, the character of the present invention will be described here and after.

DETAILED DESCRIPTION OF THE PREFERRED EMBODIMENT

Figure 1:
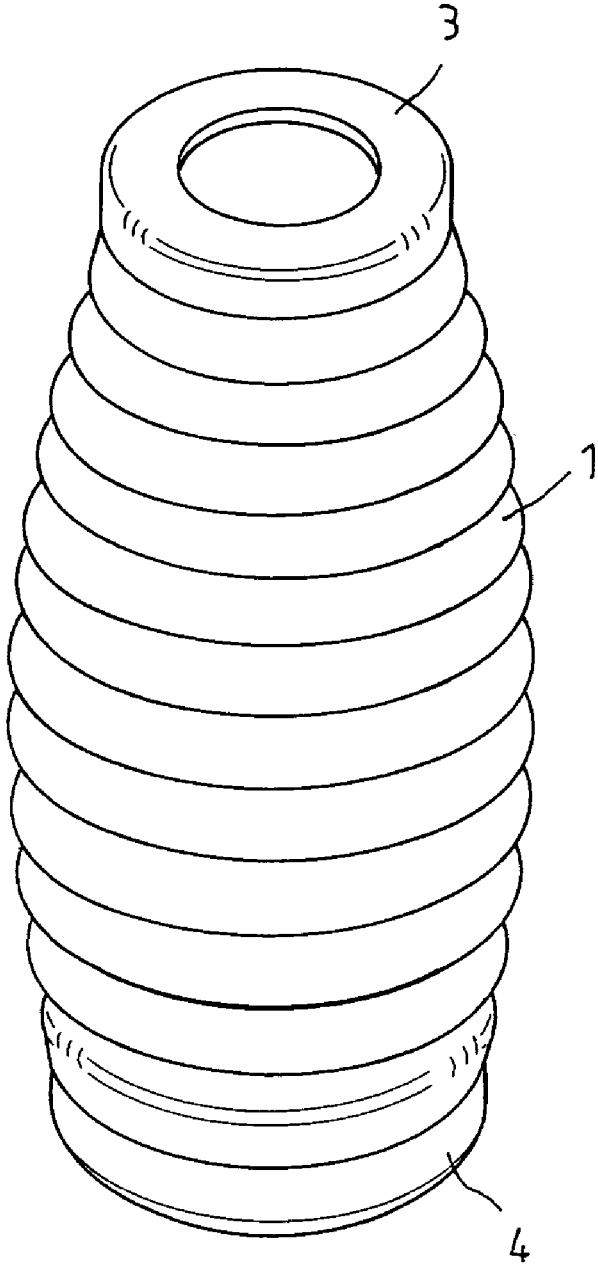
FIG. 1 is a perspective view showing a soft handle according to the present invention.
Figure 2:
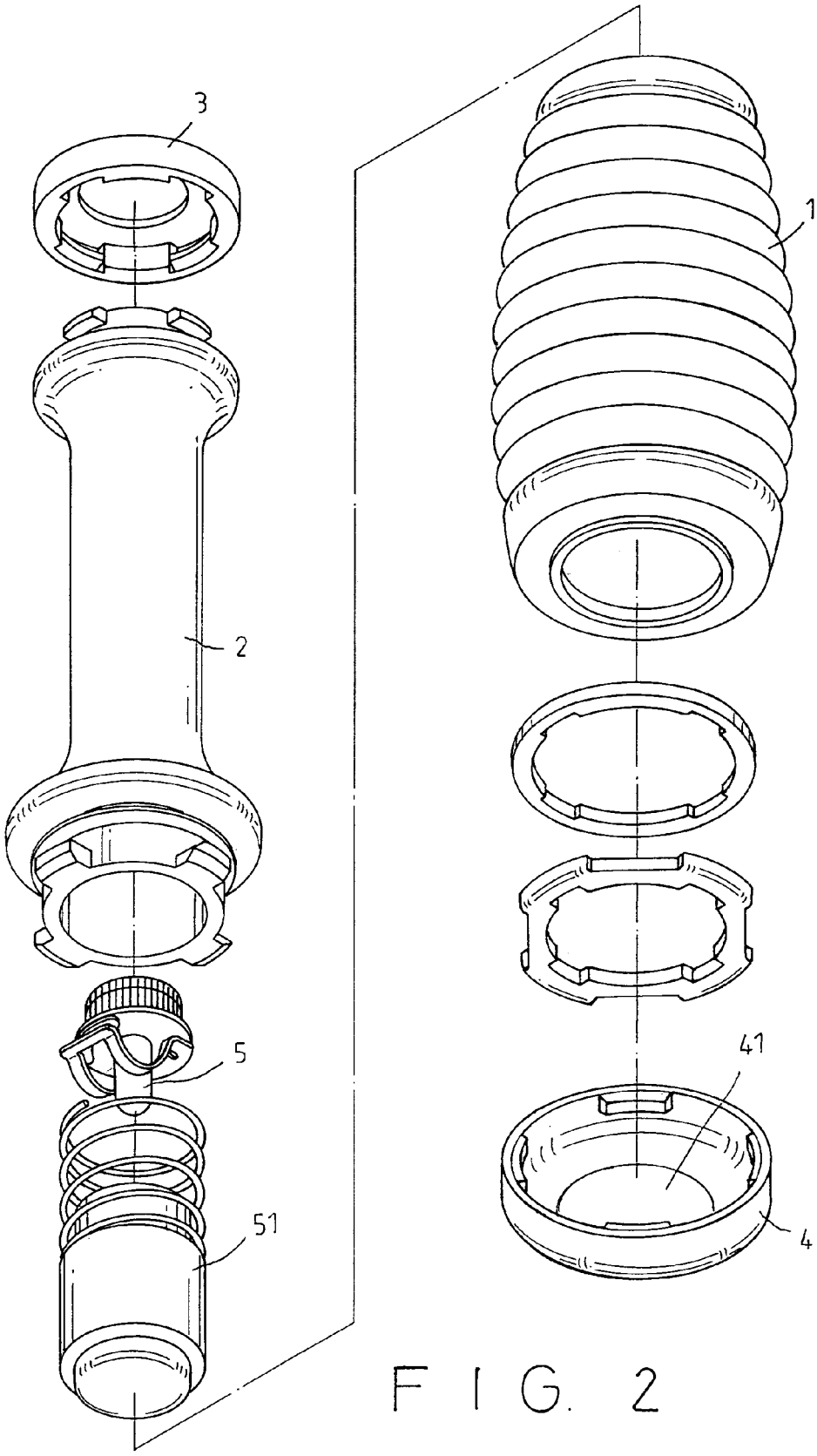
FIG. 2 is an exploded perspective view of FIG. 1.
Figure 3:
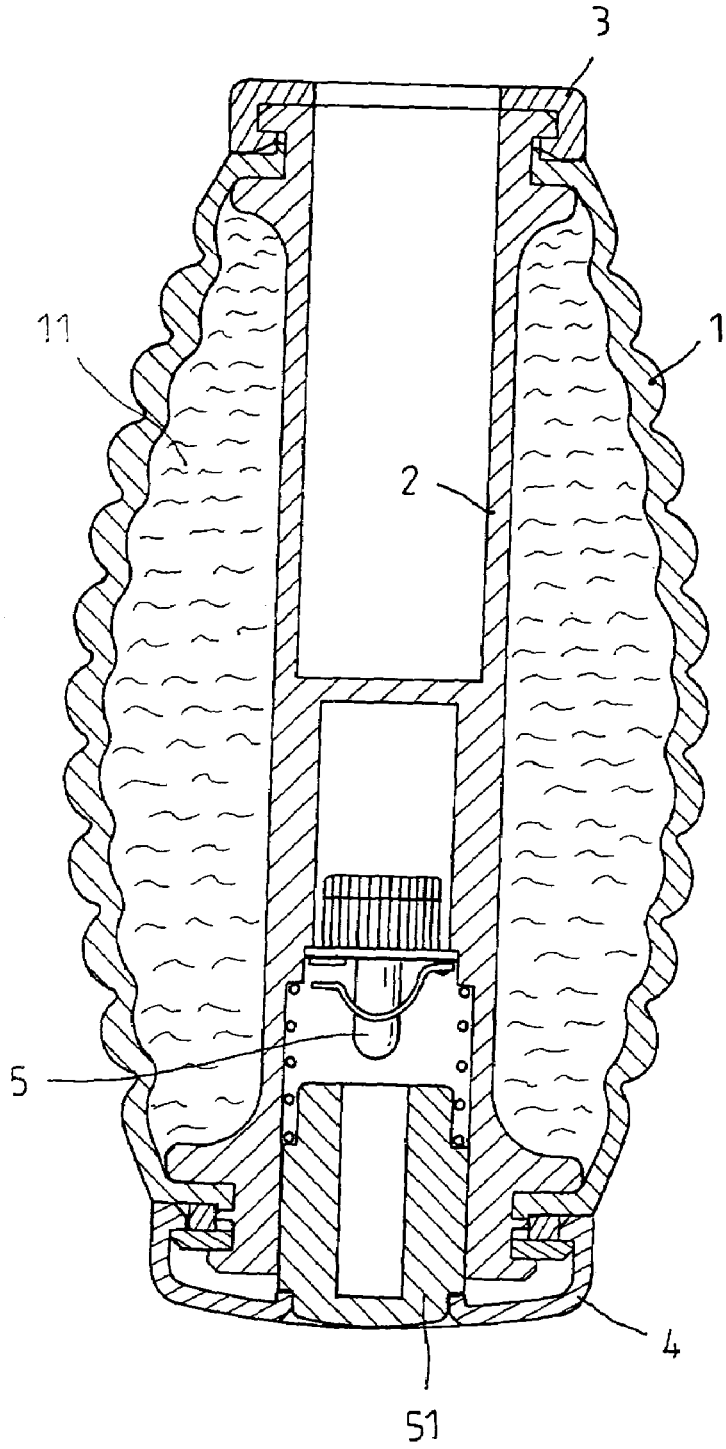
FIG. 3 is a cross-sectional plan view of FIG. 1.
Figure 4:
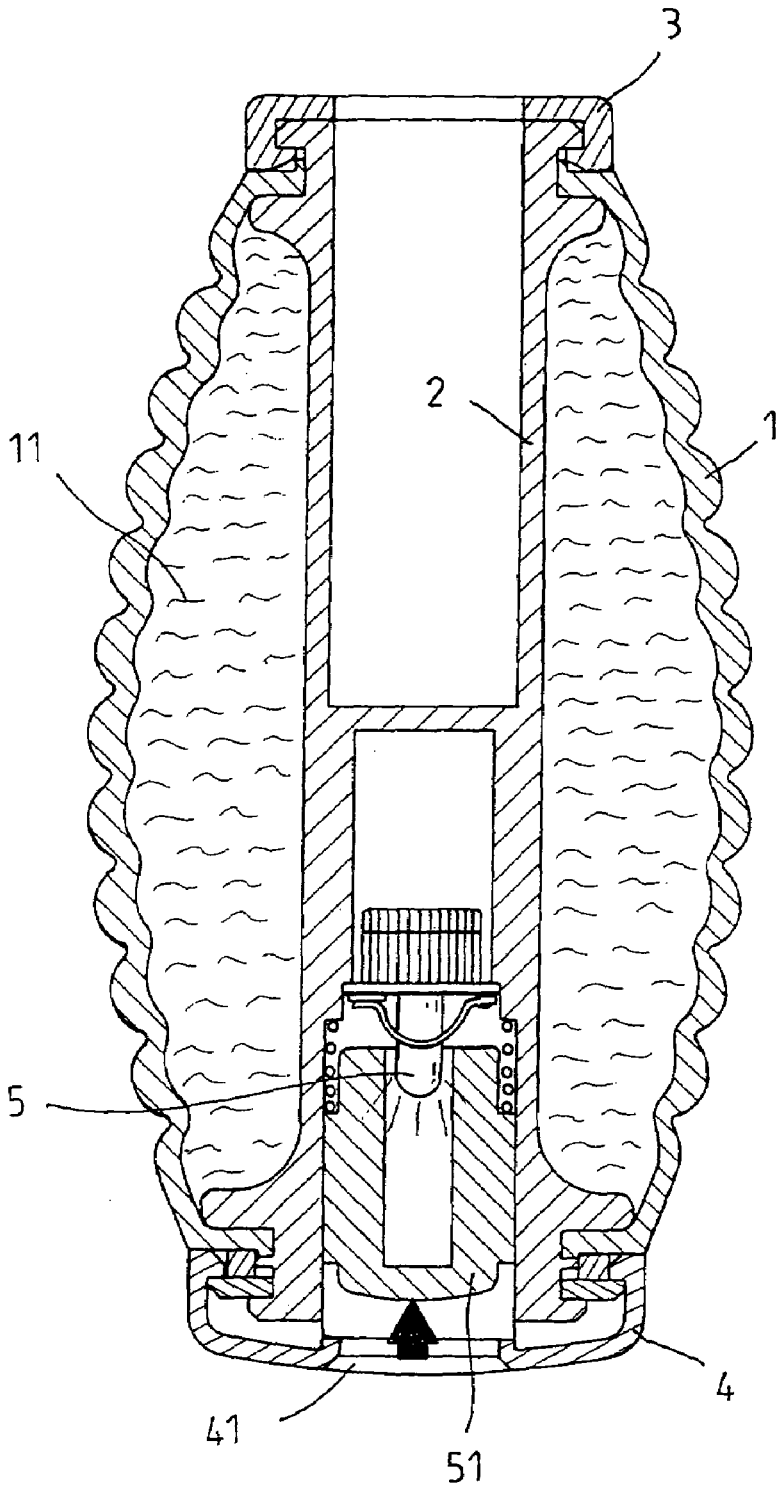
FIG. 4 is a plan view showing the handle turning on the lighting apparatus according to the present invention.

Referring to FIGS. 1 to 3, the present invention includes a soft shell (1), a shaft (2), a top cap (3), and a bottom cap (4), wherein the shaft (2) is placed in the shell (1) while the top cap (3) and the bottom cap (4) are connected to both ends of the shaft (2). Liquid (11) is fulfilled in the space between the shell (1) and the shaft (2) to complete a handle as a prior one. The character of the present invention is to provide a lighting apparatus (5) in one end of the shaft (2). A spring switch (51) is also received in the shaft (2) to control the lighting apparatus (5). The bottom cap (4) is provided with an opening (41).

In use, the handle is still a useful product since the shell (1) with inner sticky liquid (7) is very soft. As soon as lighting purpose is needed, user can just press the spring switch (51) one time to turn on the lighting apparatus (5). The lighting ray emits outside through the opening (41) of the bottom cap (4). The handle becomes like a flashlight. When user presses the spring switch (51) again, he then turns off the lighting apparatus (5). Hence, the present invention obtains utilization and improvement.

Above all, the above-mentioned structures are only embodiments, to illustrate my designs and are not to limit the scope of this application. Any modified embodiment with similar merits is still claimed by the present invention.

I claim:

1. A soft handle having a lighting apparatus including a soft shell, a shaft, a top cap, and a bottom cap, wherein the shaft is placed in the shell while the top cap and the bottom cap are connected to both ends of the shaft, and liquid is fulfilled in the space between the shell and the shaft to complete a handle; a lighting apparatus in one end of the shaft, a spring switch having a light transmissive portion received in the shaft to control the lighting apparatus, and the bottom cap provided with an opening relating to the lighting apparatus to receive the light transmissive portion of the spring switch for axial passage therethrough of light generated by the lighting apparatus.

2. The soft handle having a lighting apparatus as claimed in claim 1, wherein the spring switch can be pressed to turn on or off the lighting apparatus.

* * * * *